United States Patent [19]

Kuykendall et al.

[11] 4,432,172

[45] Feb. 21, 1984

[54] BREAKAWAY TIMBER SUPPORT POLES

[75] Inventors: Charles R. Kuykendall, Burnsville; Richard B. Castle, St. Paul, both of Minn.

[73] Assignee: Minnesota Mining & Manufacturing Company, Saint Paul, Minn.

[21] Appl. No.: 338,250

[22] Filed: Jan. 11, 1982

[51] Int. Cl.[3] ..... B24B 7/00

[52] U.S. Cl. ..... 52/98; 52/309.4; 52/309.13; 52/720; 52/741; 144/330; 144/345; 404/10; 428/541

[58] Field of Search ..... 144/330, 332, 344, 345; 52/98, 393, 403, 720, 309.4, 309.14, 741, 743, 744; 428/541; 404/9, 10; 256/1-13.1

[56] References Cited

U.S. PATENT DOCUMENTS

| | | | |
|---|---|---|---|
| 108,659 | 10/1870 | Webb . | |
| 446,852 | 2/1891 | Davis . | |
| 1,838,426 | 12/1931 | Maurer . | |
| 3,308,584 | 3/1967 | Graham | 52/98 |
| 3,355,998 | 12/1967 | Roemisch | 94/1.5 |
| 3,552,073 | 1/1971 | Millerbernd | 52/98 |
| 3,623,286 | 11/1971 | Parduhn | 52/98 |
| 3,628,296 | 12/1971 | Henry | 52/98 |
| 3,837,752 | 9/1974 | Shewchuk | 52/98 |
| 3,844,863 | 10/1974 | Forsythe et al. | 156/98 |
| 3,972,107 | 8/1976 | Deike | 29/401 R |
| 3,987,593 | 10/1976 | Svensson | 52/98 |
| 4,154,037 | 5/1979 | Anderson | 52/296 |
| 4,196,550 | 4/1980 | Svensson | 52/98 |

FOREIGN PATENT DOCUMENTS

| | | | |
|---|---|---|---|
| 331709 | 7/1930 | Canada . | |
| 889569 | 1/1972 | Canada | 20/108 |
| 1509562 | 6/1969 | Fed. Rep. of Germany | 144/330 |
| 2451639 | 5/1976 | Fed. Rep. of Germany . | |

*Primary Examiner*—W. D. Bray

*Attorney, Agent, or Firm*—D. M. Sell; J. A. Smith; R. R. Tamte

[57] ABSTRACT

Timber support poles are given desired breaking properties to reduce the deceleration of a vehicle that collides with the pole by cutting one or more recesses in the pole, and filling the recesses with a polymeric filler composition.

11 Claims, 3 Drawing Figures

BREAKAWAY TIMBER SUPPORT POLES

BACKGROUND OF THE INVENTION

Support poles or posts mounted alongside a roadway have long been recognized as a traffic hazard to motorists traveling on the roadway. As one answer to this hazard, some poles have been given a "breakaway" feature such that the poles break or collapse upon impact with a vehicle. The vehicle thus undergoes a less sharp reduction in speed and the chance and degree of injury to occupants of the vehicle is reduced.

Provision of a breakaway feature in timber utility and traffic support poles presents a special problem. It has been proposed that the poles be weakened by drilling, cutting or otherwise removing part of the pole, and such modifications do give the poles desired breakaway features. However these modifications also leave the pole without the strength needed to resist other forces that a pole commonly experiences, such as snow or ice loads or wind pressures. The result is that the poles have been unable to meet standards specified in the American National Standards Institute: National Electrical Safety Code. Attempts to mechanically reinforce the weakened pole, e.g., by clamping a sleeve around the pole or inserting shims in the recesses of the pole, have proven ineffective, aesthetically unpleasant, and/or too costly.

So far as known, there continues to be no satisfactory technique for giving timber utility and traffic support poles a satisfactory breakaway feature. Accident studies have shown that timber utility poles represent one of the most serious roadside hazards, particularly in urban areas, because of the relatively high frequency with which they are struck and the relatively high severity of these accidents. The problem is increasing as vehicles are reduced in size for energy conservation, thus increasing the need for a less hazardous timber support pole.

SUMMARY OF THE INVENTION

The present invention proceeds from the previous work on breakaway timber support poles, but succeeds in providing poles with a breakaway character while still maintaining adequate strength for normal usage. Basically timber support poles are modified according to the present invention by the steps of:

(1) cutting one or more recesses in the pole so as to weaken the pole under dynamic stresses; and (2) filling at least one of the recesses with a polymeric composition to increase the bending strength of the pole by at least about one-third over the average bending strength of the pole in its cut unfilled form.

The polymeric filler composition is chosen from compositions that flow and penetrate into the recesses in the pole, solidify without substantial shrinkage, and have good strength properties under gradual or static loading such as is experienced in a pole during or after snow, ice or wind storms. The filled pole is found to have good resistance to the latter kinds of loading (as may be indicated by a cantilever test described herein, which measures bending strength). But the modified pole has low strength under rapid rates of loading, such as are experienced when a vehicle traveling 20 or more miles per hour impacts against the pole, and the pole will break under such an impact (which may be indicated by a pendulum test described herein). Upon such an impact unrestrained occupants in the vehicle will be projected forward at a low speed, generally less than 12 meters per second (40 feet per second), which has been described as a reasonable maximum limit to minimize injury to the occupants (see National Cooperative Highway Research Program Report No. 230 "Recommended Procedures for the Safety Performance Evaluation of Highway Appurtenances").

DETAILED DESCRIPTION

Figure 1:
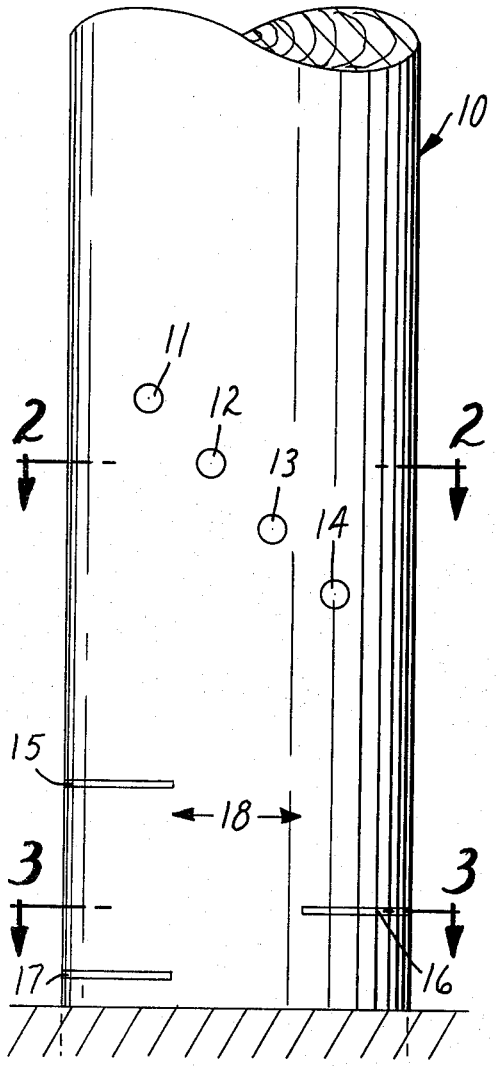
FIG. 1 is a side elevation view of a portion of a timber pole of the invention inserted in the ground.

The timber pole of the invention 10 shown in FIG. 1 has a preferred set of recesses 11–17 which were developed at the Southwest Research Institute, San Antonio, Tex., and which give the pole desired breaking properties. The pattern of receses can be varied to change breaking properties. For example, if the diagonal pattern of holes 11–14 is placed higher on the pole so as to separate it further from the slots, the bending strength and breaking resistance of the pole are increased. Also, the slots 15, 16 and/or 17 can be lengthened to lower the breaking strength of the pole.

Typical dimensions for a 40-foot, (12 meter), class 4 timber pole as shown in FIG. 1 are as follows: The center points of the top and bottom holes 11 and 14 are separated along the length of the pole by 152 millimeters and are separated along a diameter of the pole by 152 millimeters. The holes 11–14 are 25 millimeters in diameter. The center point of the bottom hole 14 is 152 millimeters above the top slot 15 in the pole. The bottom slot 17 is 25 millimeters above ground level and 152 millimeters below the top slot. The intermediate slot 16 is 76 millimeters from the ground level and the diametrical distance between the inner edges of the slots (the dimension 18 in FIG. 1) is 102 millimeters. Reduction to 76 millimeters is useful to reduce breaking resistance. The diameter of the pole at ground level is approximately 270 millimeters or greater.

Other patterns of recesses can be used, especially for poles of different height and cross section. In general the pattern of recesses cut (e.g., sawed, drilled, etc.) into the pole should be such that the pole will break when struck by a 1000-kilogram (2250-pound) vehicle traveling at about 30 kilometers per hour (20 miles per hour) or more and impose the previously noted forward projection on unrestrained occupants of less than 12 meters per second (40 feet per second), and preferably less than 10 meters per second (30 feet per second). The susceptibility to such breaking is typically measured with a pendulum test, in which a 1000-kilogram (2250-pound) mass with a crushable honeycomb nose is swung through a 7.2-meter-radius (24-foot-radius) arc. The timber test specimen is mounted at the lowest point of the pendulum arc, and a damp uniformly graded sand is tamped around the pole base. The change in velocity of the pendulum is measured (see "Development of Safer Utility Poles" by J. J. Labra, Interim Report No. FHWA-RO-034502 of the Federal Highway Administration, page 103, for test apparatus), and this change in velocity is the velocity at which unrestrained occupants of a vehicle undergoing such a change in velocity would be projected forward.

The recesses can be formed in poles already installed in the ground, or they can be formed in poles that are being prepared for installation. The invention is most often used in connection with rather long poles such as used for utility purposes, but the invention is also effective in shorter poles or posts, and the term "pole" is used herein to refer to poles of whatever length or cross-sectional shape or diameter.

The polymeric filler composition generally comprises ingredients that react to a solid state when exposed to ambient temperatures and an outdoor environment. The composition will typically be stored in two parts and mixed immediately prior to use. Prior to solidifying or curing and at the stage where it is injected into the pole, the composition should have a viscosity less than about 50,000 centipoises, so as to fill the holes and penetrate into the cracks and pores of the wood in the pole. The poles may be wrapped with tape around the cut portion, and a nozzle-type gun used to inject the filler composition into the recesses. The liquid filler composition solidifies and adheres to the wood. Preferably, the composition will react at 20° C. over a period of about 10–500 minutes so as to give adequate handling time.

Another advantage of filled poles of the invention is that the synthetic polymeric material offers a barrier over part of the pole to the ingress of moisture which would eventually lead to rotting of the pole, especially at the core of the pole to which a preservative such as creosote may not have reached. It is desirable that the filler composition penetrate the recesses sufficiently to seal off at least the untreated portions of a pole.

Epoxy resin-based compositions, especially those using an amine or amide curing agent, offer a desirable combination of strength properties and good bonding to wood. Polyester-based compositions are also useful, generally including ingredients that react at room temperature to a solid state. Catalysts such as benzoyl peroxide and reaction promoters such as dimethylaniline or diethylaniline may be included.

Whatever the particular composition used, it should return a significant portion of the original bending strength of the pole, generally by at least one-third, and preferably by at least one-half, of the bending strength of the pole in its cut form. Bending strength may be measured in a cantilevering apparatus. The test pole is inserted horizontally in a fixed collar, with the base of the pole located six feet (1.8 meters) past the collar. A crane with a wire rope and load cell is attached near the free end of the cantilevered specime pole is lifted with the crane until fracture occurs (see "Development of Safer Utility Poles," by Labra, supra, page 73).

The composition may contain additives such as hollow microspheres, or glass bubbles. A good level of compressive strength is retained despite the presence of the hollow microspheres but tensile strength under impact-type loading is reduced. The combination of a hollow microsphere-filled composition in a pattern of recesses as described gives a useful combination of breaking and strength properties. Other filler particles such as calcium carbonate, talc, diatomaceous earth, amorphous silica, wollastonite, or a combination of such fillers with or without chopped glass are generally included in the composition to lower its cost, control flow, and enhance certain strength properties.

Illustrative useful formulations are shown in the following examples:

EXAMPLE 1

| | Parts by Weight |
|---|---|
| Diglycidyl ether of bisphenol A (Epon 828 supplied by Shell Chemical Co.) | 2400 |
| Polyamide condensation product of polymerized fatty acid and polyamine having an amine value of 370–400 (Versamide 150 supplied by Henkel Corp. | 1700 |
| Polyester plasticizer supplied by Emery Industries, Inc. | 45 |
| Diatomaceous earth | 670 |

Upon mixing, the filler composition had a viscosity of 31,000 centipoises at 20° C. (Brookfield viscosity, No. 4 spindle, at 12 rpm). The compressive strength of the cured composition (measured by ASTM D 695) ranged from 10,600 to 11,000 pounds per square inch (73,076 to 75,834 kilonewtons per square meter) the flexural strength (measured by ASTM D 790) ranged from 7,750 to 9,220 pounds per square inch (53,428 to 63,562 $kN/m^2$), and the shear modulus averaged $1.1\times10^{10}$ dynes per square centimeter (480,000 pounds per square inch). A representative compressive strength for a wood utility pole is approximately 58,600 $kN/m^2$ (8500 pounds per square inch).

Figure 2:
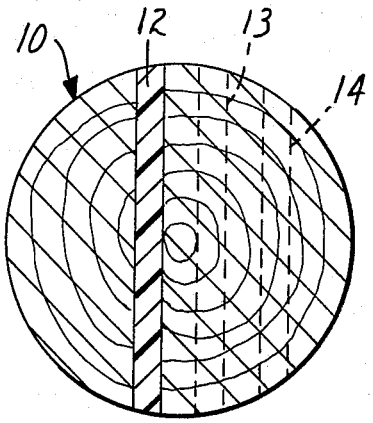
FIG. 2 is a sectional view through the pole shown in FIG. 1 taken along the lines 2—2 of FIG. 1.
Figure 3:
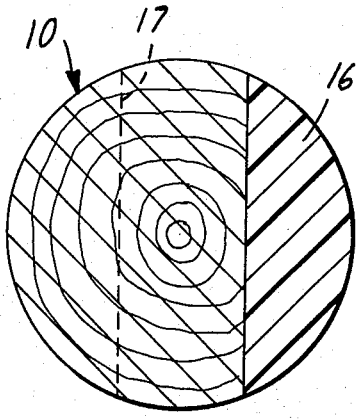
FIG. 3 is a sectional view taken along the lines 3—3 of FIG. 1.

A set of class 4 timber poles having holes and slots as shown in FIGS. 1–3 with dimensions as described above was wrapped around the cut portion with vinyl tape, and the tape stapled to the poles. Holes were cut in the tape wrappings, the above-described filler composition injected into the recesses using an air-operated caulking gun, and the composition allowed to cure at ambient temperatures (about 20°–25° C.). Two of the poles were tested in the described cantilever test and found to average 83 percent of the design level bending strength (3000 pounds; 13,344 newtons) for the pole. Poles having the same holes and slots but not filled with any material have been found to average about 55 percent of the design level bending strength. Thus, the bending strength of the pole after filling with the filler composition increased by about 51 percent over the strength of the pole in its cut form (83 minus 55 divided by 55). In the pendulum test two poles were tested and caused changes in the velocity of the pendulum, respectively, of 20.46 feet per second and 16.85 feet per second (6.2 and 5.13 meters per second) (it was noted that the bottom of the pendulum caught on the stub of pole left in the ground which may have increased the change in velocity that was observed).

The described filler composition was also used to fill a 250-millimeter-diameter pole having holes and slots as shown in FIGS. 1–3 and as described above (the dimension 18 in FIG. 1 was 76 millimeters and the horizontal distances between holes was reduced from that specified above in proportion to the narrower diameter of pole). In the pendulum test, a change in velocity of 12.5 feet per second (3.8 meters per second) was measured.

EXAMPLE 2

The following ingredients were mixed together:

| | Parts by Weight |
|---|---|
| Diglycidyl ether of bisphenol A (Epon 828 supplied by Shell | 2400 |

-continued

| | Parts by Weight |
|---|---|
| Chemical Co.) | |
| Accelerated cycloaliphatic amine having an active-hydrogen equivalent weight of 85 (Ancamine 1561 supplied by Pacific Anchor Chemical Company) | 1200 |
| Amorphous silica (Ismil A-10 supplied by Illinois Mineral Co.) | 1350 |

The mixed filler composition had a viscosity of 1100 centipoises at 20° C. (Brookfield viscosity, No. 3 spindle, at 60 rpm). The compressive strength of the cured composition ranged from 10,800 to 11,000 pounds per square inch (74,463 to 75,842 $kN/m^2$), the flexural strength from 4,920 to 11,030 pounds per square inch (33,922 to 76,049 $kN/m^2$), and the modulus was 1.7 times $10^{10}$ dynes per square centimeter (650,000 pounds per square inch).

Two class 4 timber poles having recesses as shown in FIGS. 1–3 and with dimensions as described above were filled by the method described in Example 1. One of the poles was subjected to the cantilever test as described above and found to exhibit 79 percent of the pole's design level bending strength, an increase of 43 percent over the bending strength of the cut pole. Two similarly filled poles were tested in the pendulum test and found to cause changes in velocity, respectively, of 18.57 and 23.58 feet per second (5.66 and 7.19 meters per second).

EXAMPLE 3

| | Volume-Percent |
|---|---|
| Unsaturated polyester resin in styrene solvent (Corezyn 115-36 supplied by Worum Chemical Co.) | 48.3 |
| Hollow glass microspheres averaging 35 micrometers in diameter | 26.0 |
| Titanium dioxide pigment | 0.4 |
| Calcium carbonate | 24.0 |
| Dimethylaniline promoter | 0.3 |
| Benzoyl peroxide catalyst | 1.0 |

A filler composition as described was mixed and injected into a class 4 pole having the pattern of recesses shown in FIGS. 1–3 of the drawings and dimensions as described above. The test poles averaged 85 percent of the design level bending strength in the cantilever test, an increase of 54 percent over the bending strength of the cut pole. The composition had a viscosity of 13,500 centipoises (Brookfield viscosity, No. 4 spindle, 60 rpm) and a compressive strength of 9500–10,000 psi. In the pendulum test, a pole filled with the described filler composition of this example slowed the pendulum from 20 miles per hour to 7 miles per hour (32 to 11 kilometers per hour).

A full-scale crash test using a 1973 Ford Pinto (about 2250 pounds, 1000 kilograms) was impacted at 30 miles per hour (48 kilometers per hour) against a described pole filled with composition of the example and embedded in the ground. The test pole broke and resulted in projecting a non-human test object forward at 35 feet per second (10.6 meters per second).

What is claimed is:

1. A method for modifying a timber support pole prior to or after insertion in the ground near a roadway to reduce impact forces if a vehicle collides with the pole, comprising the steps of (1) cutting one or more recesses in the pole to weaken the pole under dynamic stresses, whereby the pole will break upon impact by a 1000-kilogram vehicle traveling 30 or more kilometers per hour, and unrestrained occupants in the vehicle will be projected forward at less than 12 meters/second; and (2) filling at least one of the recesses with a polymeric filler composition to increase the bending strength of the pole by at least one-third over the bending strength of the pole in its cut unfilled form.

2. A method of claim 1 in which a plurality of recesses are cut, including two spaced slots parallel to ground level cut in the side of the pole facing oncoming traffic and a slot parallel to ground level cut in the opposite side of the pole and intermediate the level of the traffic-facing slots, and further including a plurality of cylindrical holes disposed higher on the pole than the slots, extending through the pole in a direction transverse to oncoming traffic, and aligned along a diagonal line, with the hole closest to oncoming traffic being higher above ground level than the hole furthest from oncoming traffic.

3. A method of claim 1 in which the polymeric filler composition comprises ingredients that react to a solid state at ambient temperature in an outdoor environment, said material having a viscosity of less than about 50,000 centipoises when inserted into the recesses of the pole.

4. A method of claim 1 in which the polymeric filler composition includes dispersed hollow microspheres.

5. A method of claim 1 in which the polymeric filler composition comprises a polyester.

6. A pole prepared by the method of claim 1, 2, 3, 4, or 5.

7. A method for modifying a timber support pole prior to or after insertion in the ground near a roadway to reduce impact forces if a vehicle collides with the pole, comprising the steps of (1) cutting a plurality of recesses in the pole, including two spaced slots parallel to ground level cut in the side of the pole facing oncoming traffic and a slot parallel to ground level cut in the opposite side of the pole and intermediate the level of the traffic-facing slots, and further including a plurality of cylindrical holes disposed higher on the pole than the slots, extending through the pole in a direction transverse to oncoming traffic, and aligned along a diagonal line, with the hole closest to oncoming traffic being higher above ground level than the hole furthest from oncoming traffic, said cuts weakening the pole under dynamic stresses whereby the pole will break upon impact by a 1000-kilogram vehicle traveling 30 kilometers per hour, and unrestrained occupants in the vehicle will be projected forward at less than 12 meters/-second; and (2) filling the recesses with a synthetic polymeric material to increase the bending strength of the pole by at least one-half of the bending strength of the pole in its cut unfilled form, said polymeric filler composition comprising ingredients that react to a solid state at ambient temperature in an outdoor environment, said composition having a viscosity of less than about 50,000 centipoises when inserted into the recesses of the pole.

8. A method of claim 7 in which the filler composition comprises polyester ingredients.

9. A method of claim 7 or 8 in which the polymeric filler composition includes dispersed hollow microspheres.

10. A pole prepared by the method of claim 7 or 8.

11. A pole prepared by the method of claim 9.

* * * * *